US009580265B2

(12) United States Patent
Sano et al.

(10) Patent No.: US 9,580,265 B2
(45) Date of Patent: Feb. 28, 2017

(54) IMAGE RECORDING APPARATUS

(71) Applicant: BROTHER KOGYO KABUSHIKI KAISHA, Nagoya-shi, Aichi-ken (JP)

(72) Inventors: Iwane Sano, Obu (JP); Shota Iijima, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/865,328

(22) Filed: Sep. 25, 2015

(65) Prior Publication Data

US 2016/0090258 A1 Mar. 31, 2016

(30) Foreign Application Priority Data

Sep. 25, 2014 (JP) ..... 2014-194543

(51) Int. Cl.

| | |
|---|---|
| ***B65H 85/00*** | (2006.01) |
| ***B65H 5/38*** | (2006.01) |
| ***B65H 29/58*** | (2006.01) |
| ***B65H 3/06*** | (2006.01) |
| ***B65H 5/06*** | (2006.01) |

(52) U.S. Cl.

CPC ..... *B65H 29/58* (2013.01); *B65H 3/0669* (2013.01); *B65H 5/062* (2013.01); *B65H 5/38* (2013.01); *B65H 85/00* (2013.01); *B65H 2301/33312* (2013.01); *B65H 2403/40* (2013.01); *B65H 2403/50* (2013.01); *B65H 2403/942* (2013.01); *B65H 2404/632* (2013.01); *B65H 2801/06* (2013.01)

(58) Field of Classification Search

CPC ..... B65H 2301/33312; B65H 85/00; B65H 29/58; B41J 13/0045

See application file for complete search history.

(56) References Cited

U.S. PATENT DOCUMENTS

| | | | | |
|---|---|---|---|---|
| 8,240,655 | B2 * | 8/2012 | Samoto | B41J 3/60 271/10.13 |
| 2010/0245515 | A1 | 9/2010 | Uchida et al. | |

FOREIGN PATENT DOCUMENTS

| | | | |
|---|---|---|---|
| JP | 5-556 | A | 1/1993 |
| JP | 2010-076421 | A | 4/2010 |
| JP | 2013049279 | A * | 3/2013 |

* cited by examiner

*Primary Examiner* — Luis A Gonzalez
(74) *Attorney, Agent, or Firm* — Merchant & Gould P.C.

(57) ABSTRACT

An image recording apparatus, including a tray configured to support a sheet; a chassis defining a first conveyer path, in which the sheet on the tray is conveyed in a first conveying direction, and a second conveyer path, through which the sheet is conveyed in a second conveying direction through a branch point to be inverted to reenter the first conveyer path through a merging point; a base member integrally formed of resin and including a guiding section to define a form of a part of the second conveyer path; a recording unit to record an image on the sheet conveyed in the first conveyer path; a drive shaft supported by the base member; and a return-conveyer roller disposed in the second conveyer path and configured to convey the sheet to be guided on the guiding section in the second conveying direction by rotation of the drive shaft, is provided.

9 Claims, 11 Drawing Sheets

IMAGE RECORDING APPARATUS

CROSS REFERENCE TO RELATED APPLICATION

This application claims priority from Japanese Patent Application No. 2014-194543, filed on Sep. 25, 2014, the entire subject matter of which is incorporated herein by reference.

BACKGROUND

Technical Field

The present invention relates to an image recording apparatus capable of recording an image on either side of a sheet.

Related Art

An image recording apparatus capable of recording an image on either side of a sheet is known. The image recording apparatus may have a first conveyer path, along which a recording unit is disposed, and a second conveyer path, which inverts the sheet with the image recorded on a first side and directs the inverted sheet to the first conveyer path so that another image may be recorded on second side of the sheet. In the first and second conveyer paths, a plurality of rollers may be disposed to convey the sheet.

Meanwhile, in order to reduce a size, a quantity of parts, and manufacturing cost of the image recording apparatus, a paper chute serving as a part of a conveyer path to guide the sheet may be integrally formed in a base member, which is made of a resin.

SUMMARY

The resin-made base member may deform for a larger amount than a metal-made member when an external force is applied thereto. Therefore, it may be difficult to maintain the resin-made member in the conveyer path in a correct position. For example, if positional accuracy of a roller to convey the sheet on the base member is lowered, the sheet being conveyed by the roller may skew or jam in the conveyer path. The positional inaccuracy in the members that form the conveyer paths may be caused more easily when the resin-made base member, in which the conveyer paths are formed, is thinner.

The present disclosure is advantageous in that an image recording apparatus capable of recording an image on either side of a sheet, in which positional accuracy of parts to be arranged on the conveying path may be prevented from being lowered while positions of the parts may be defined by a position of the resin-made base member, is provided.

According to an aspect of the present disclosure, an image recording apparatus, including a tray configured to support a sheet; a chassis defining a first conveyer path, in which the sheet supported on the tray is conveyed in a first conveying direction, and a second conveyer path, which is branched from the first conveyer path at a branch point and merged with the first conveyer path at a merging point, the second conveyer path, through which the sheet is conveyed in a second conveying direction, guiding the sheet to be inverted to reenter the first conveyer path through the merging point; a base member integrally formed of resin and including a guiding section, which defines a form of a part of the second conveyer path; a recording unit configured to record an image on the sheet conveyed in the first conveyer path; a drive shaft supported by the base member; and a return-conveyer roller disposed in the second conveyer path and configured to convey the sheet to be guided on the guiding section in the second conveying direction by rotation of the drive shaft, is provided.

BRIEF DESCRIPTION OF THE ACCOMPANYING DRAWINGS

Figure 4B:
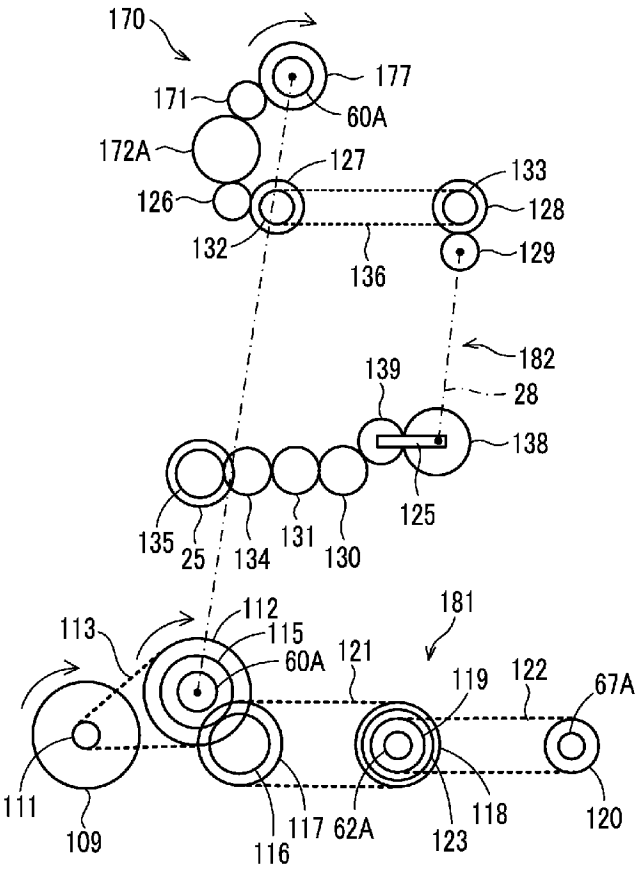
Figure 4A:
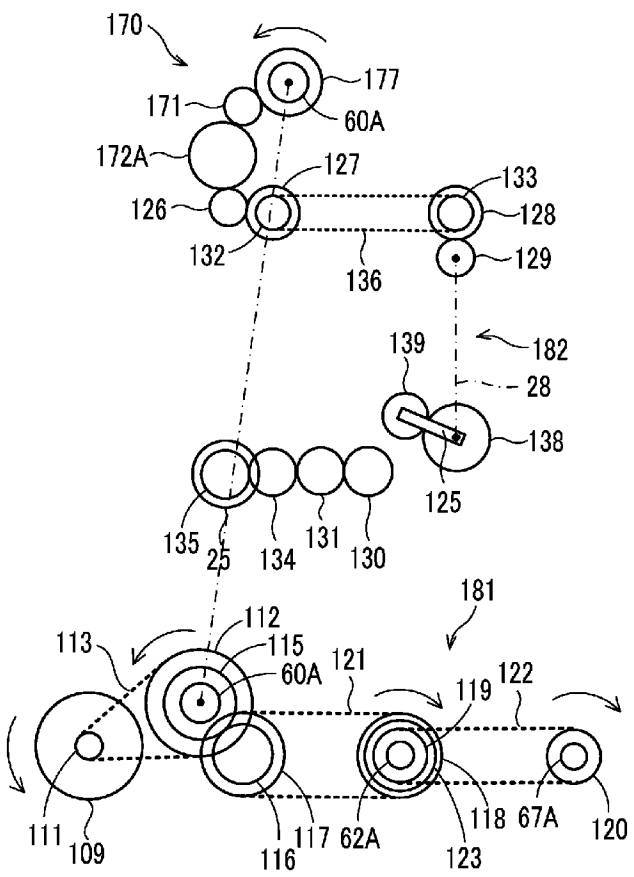

FIG. 4A is an illustrative view of a first transmission 181 and a second transmission 182 when a conveyer motor 109 is in a normal rotation in the MFD 10 according to the embodiment of the present disclosure. FIG. 4B is an illustrative view of the first transmission 181 and the second transmission 182 when the conveyer motor 109 is in a reverse rotation in the MFD 10 according to the embodiment of the present disclosure.

Figure 5B:
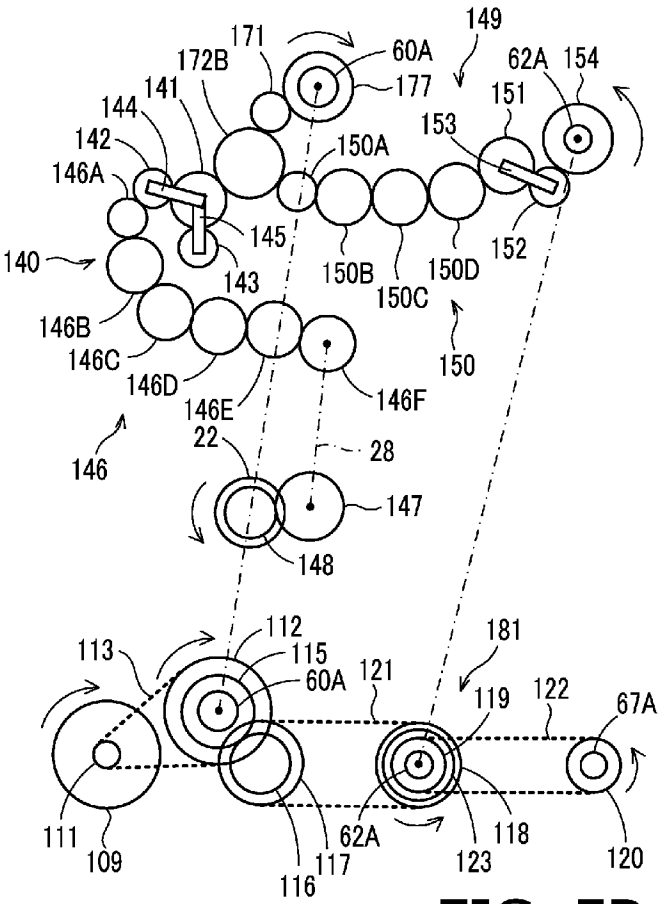
Figure 5A:
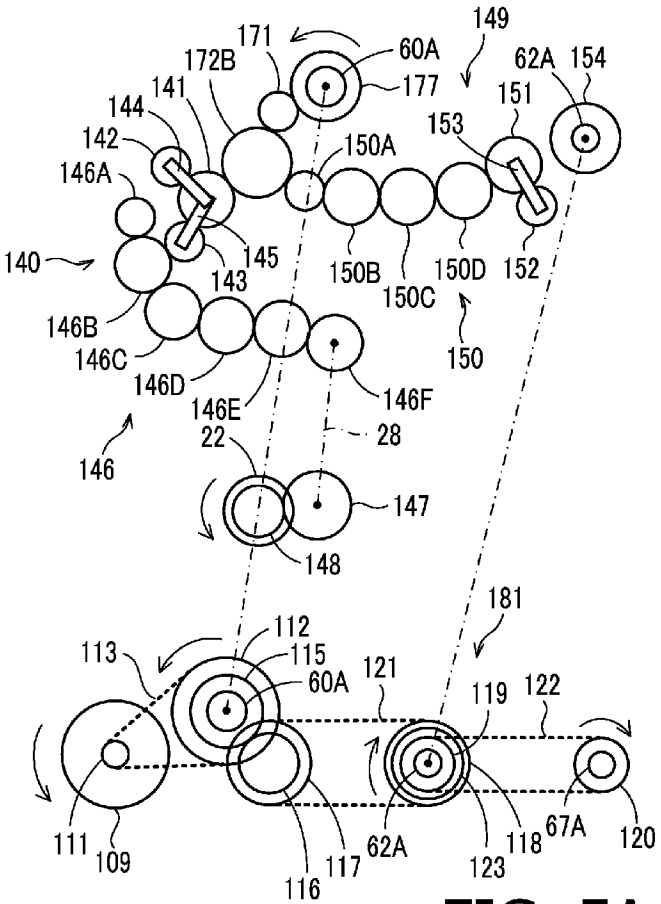

FIG. 5A is an illustrative view of the first transmission 181, a third transmission 140, and a fourth transmission 149 when the conveyer motor 109 is in the normal rotation in the MFD 10 according to the embodiment of the present disclosure. FIG. 5B is an illustrative view of the first transmission 181, the third transmission 140, and the fourth transmission 149 when the conveyer motor 109 is in the reverse rotation in the MFD 10 according to the embodiment of the present disclosure.

Figure 6:
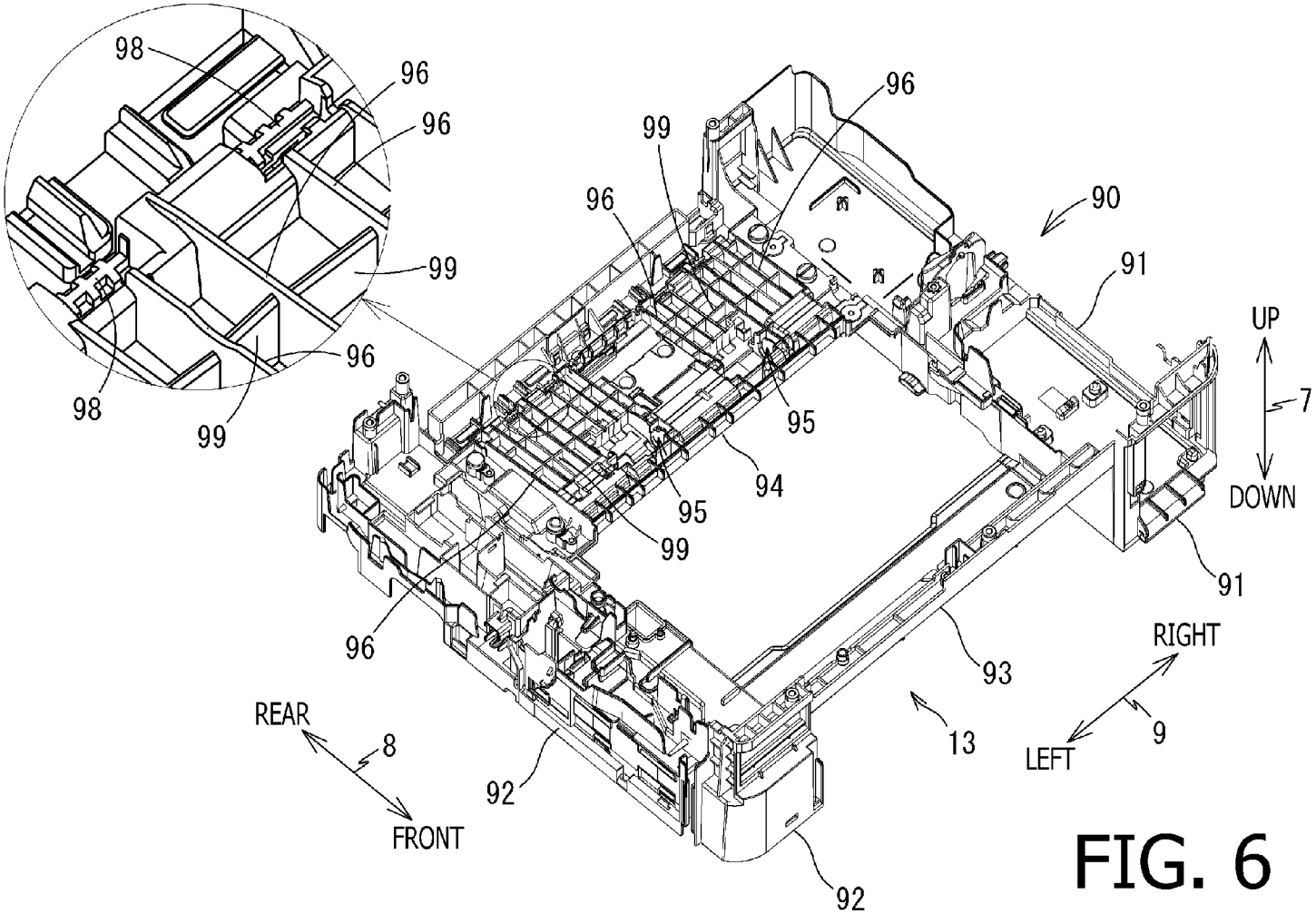

FIG. 6 is a perspective view of a base member 90 in the MFD 10 according to the embodiment of the present disclosure.

Figure 7:
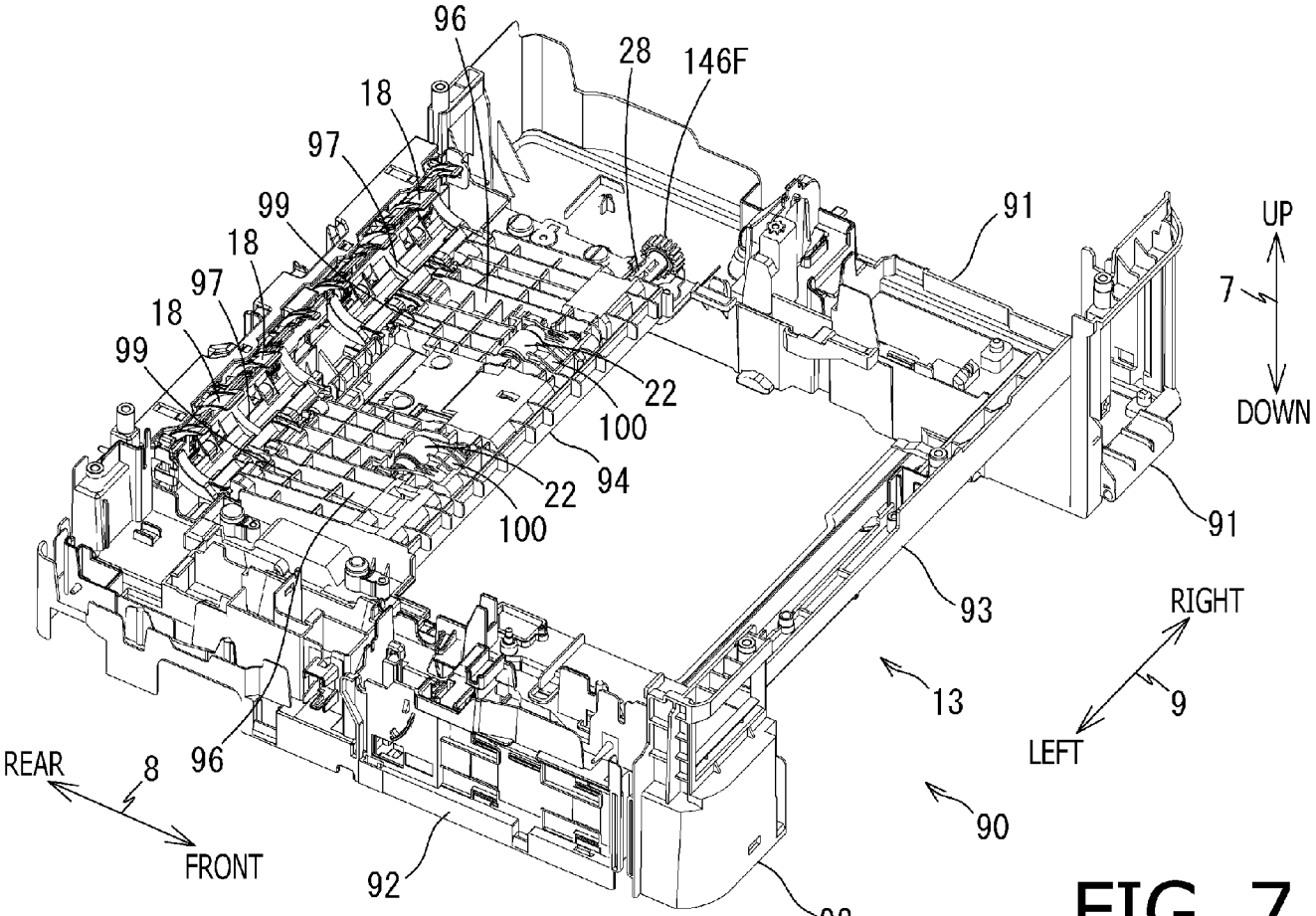

FIG. 7 is a perspective view of the base member 90, accompanied with a return-conveyer roller 22, a second flapper 97, and an outer guide member 18, in the MFD 10 according to the embodiment of the present disclosure.

Figure 8:
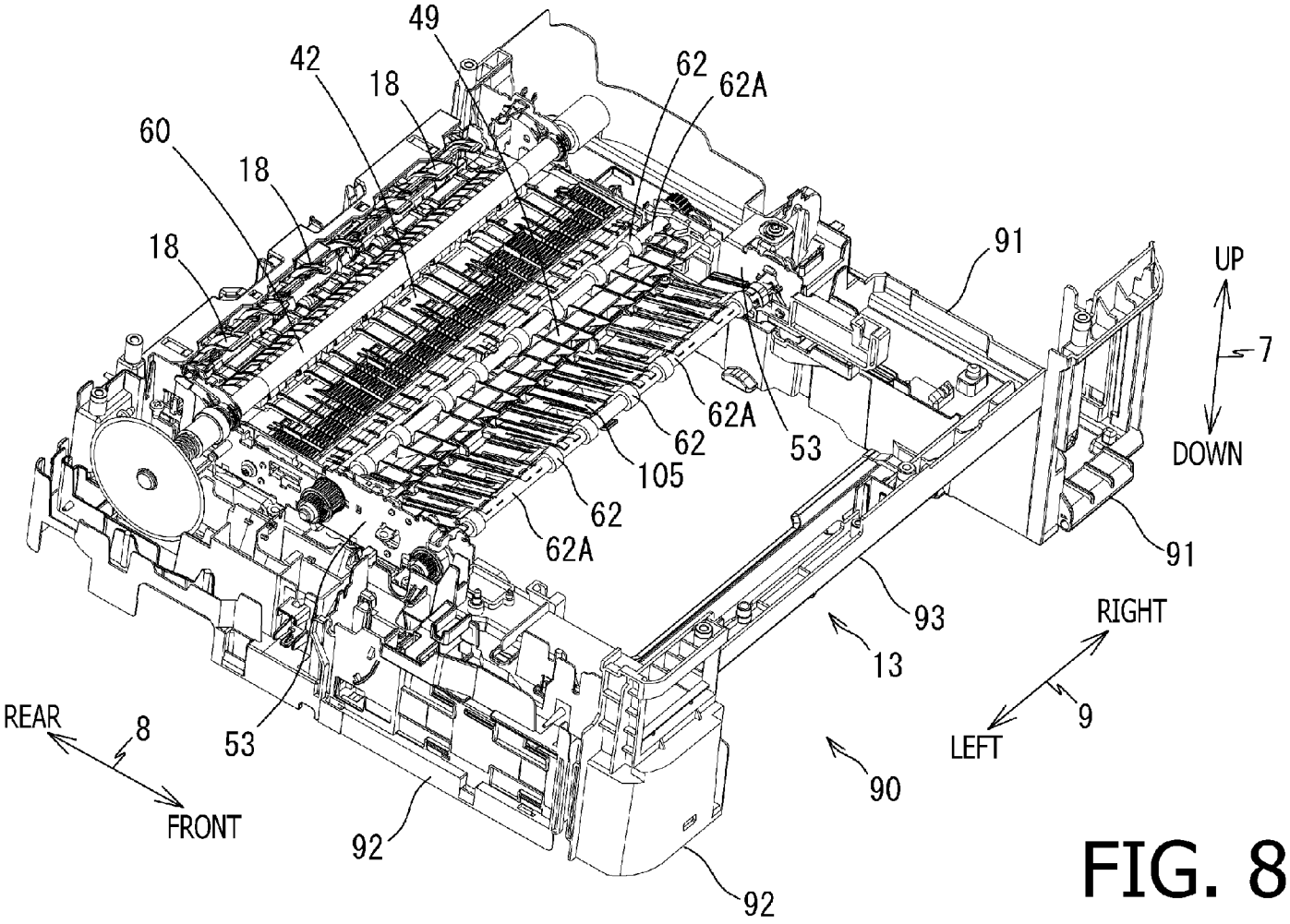

FIG. 8 is a perspective view of the base member 90, accompanied with a platen 42, a lower guide member 105, a first flapper 49, a conveyer roller 60, a discharge roller 62, a reversible roller 67, and a lateral frame 53, in the MFD 10 according to the embodiment of the present disclosure.

Figure 9:
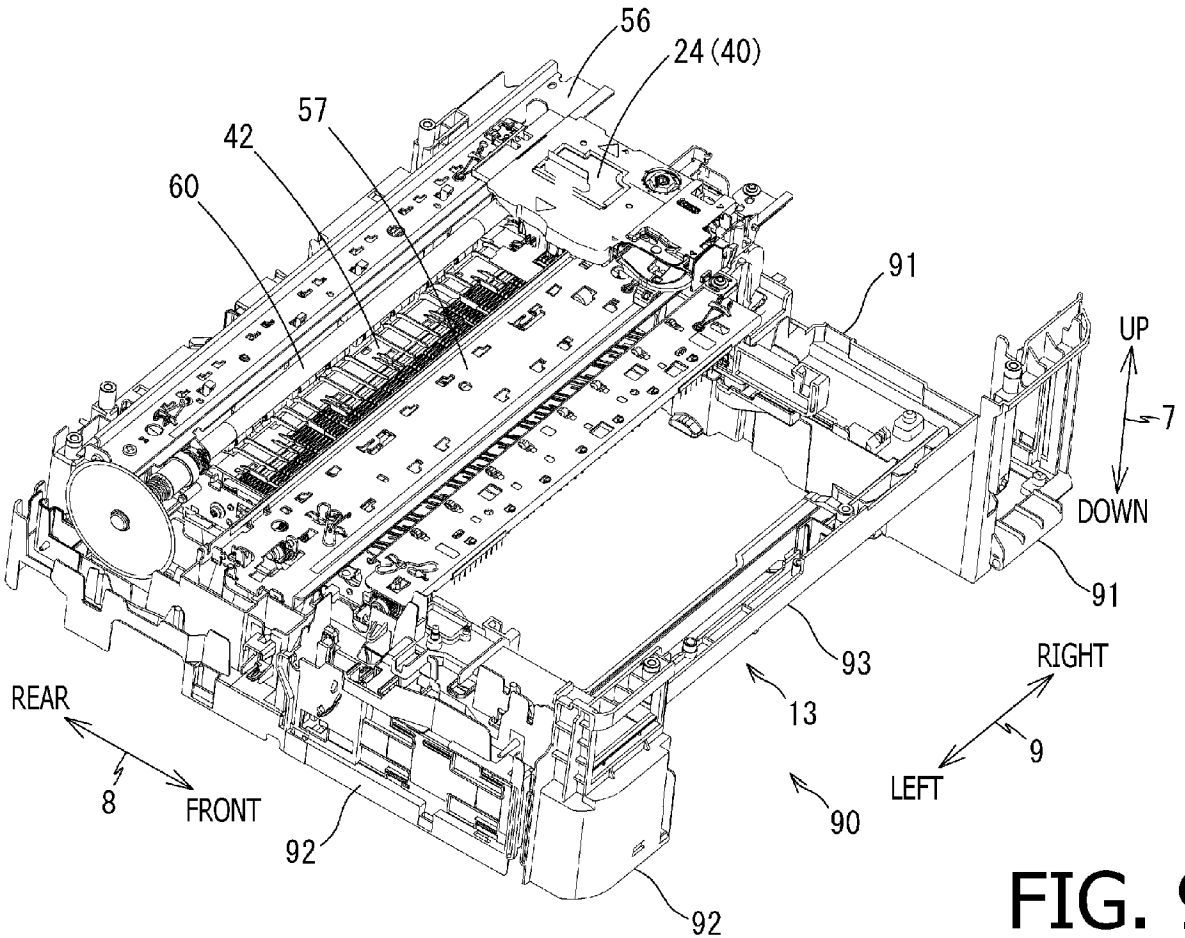

FIG. 9 is a perspective view of the base member 90, accompanied with guide rails 56, 57 and a recording unit 24, in the MFD 10 according to the embodiment of the present disclosure.

Figure 10A:
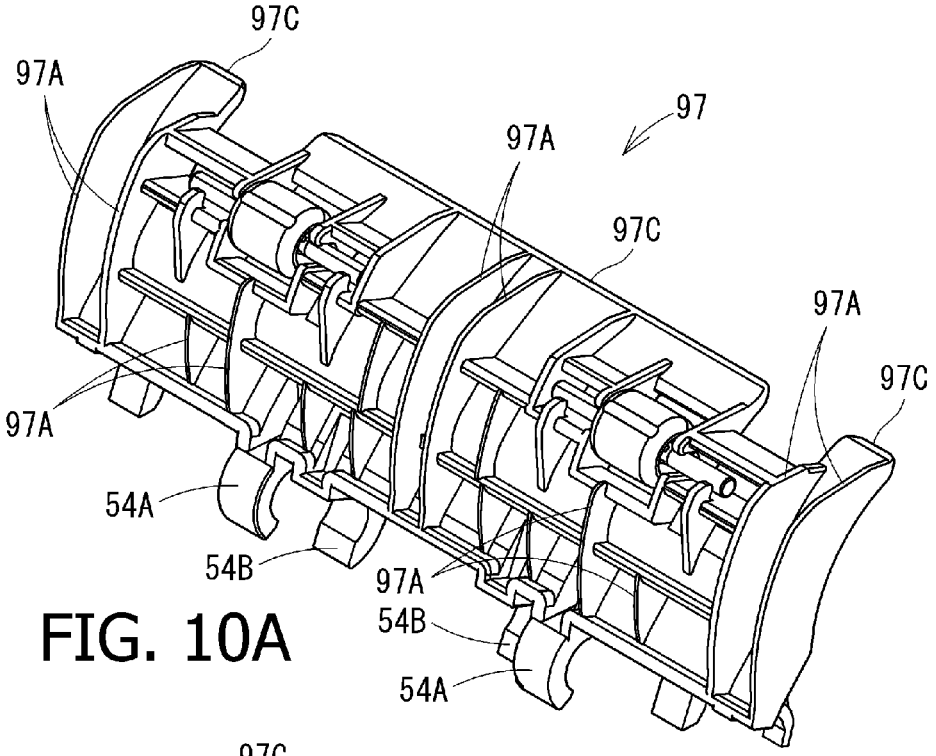
Figure 10B:
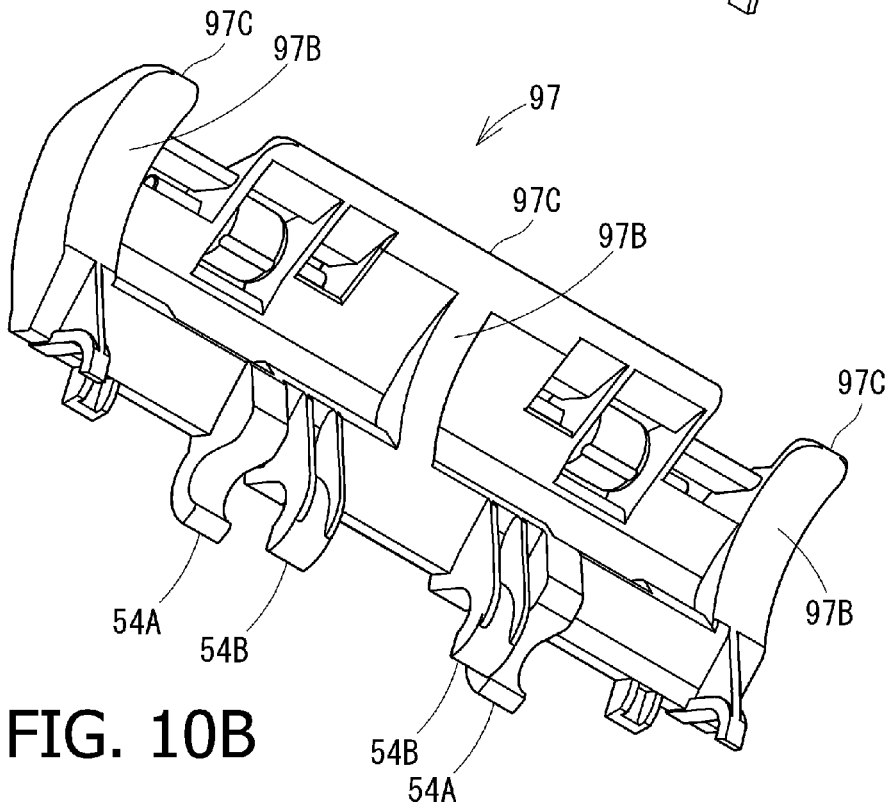

FIGS. 10A-10B are perspective views of the second flapper 97 in the MFD 10 according to the embodiment of the present disclosure.

Figure 11:
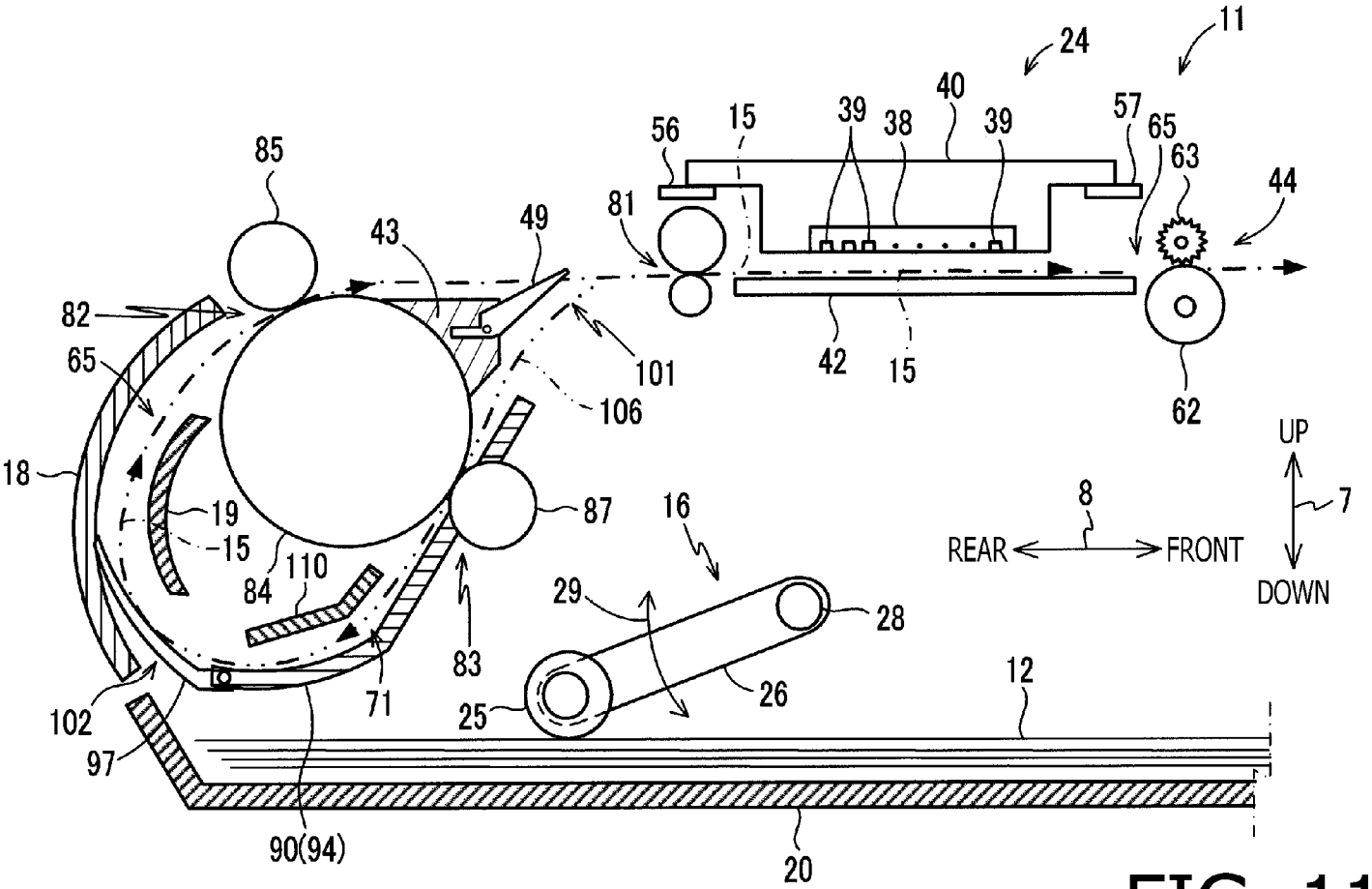

FIG. 11 is a cross-sectional side view of an internal structure of the printer 11 in the MFD 10 according to a modified example of the embodiment of the present disclosure.

DETAILED DESCRIPTION

Hereinafter, an embodiment according to the present disclosure will be described in detail with reference to the accompanying drawings. It is noted that various connections are set forth between elements in the following description. These connections in general and, unless specified otherwise, may be direct or indirect and that this specification is not intended to be limiting in this respect.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-right side in FIG. 1, on which an opening 13 is formed, is defined to be a front side of the MFD 10, and a side opposite from the front side, i.e., a viewer's upper-left side, is defined as a rear side of the MFD 10. A front-to-rear or rear-to-front direction is defined as a direction of depth and may be referred to as a front-rear direction 8. A lower-left side in FIG. 1, which comes on the user's left-hand side with respect to the MFD 10 when the user faces the front side, is referred to as a left side or a left-hand side. A side opposite from the left, which is on the viewer's upper-right side, is referred to as a right side or a right-hand side. A right-to-left or left-to-right direction of the MFD 10 may also be referred to as a right-left direction 9 or a widthwise direction 9. The directions shown in FIGS. 2-3 and 6-10B correspond to those indicated by the arrows appearing in FIG. 1.

[Overall Configuration of the MFD 10]

Figure 1:
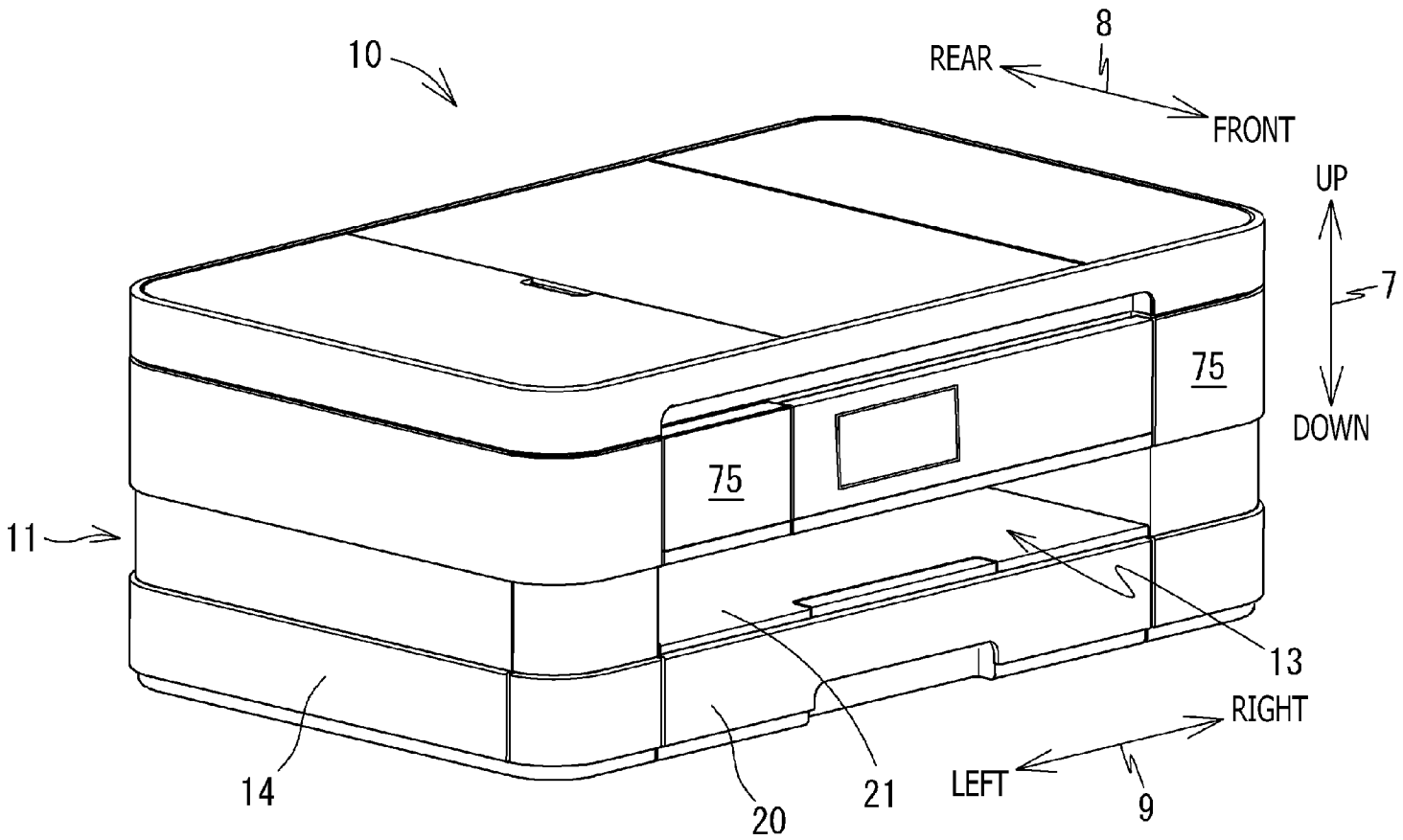
FIG. 1 is an external perspective view of a multifunction device (MFD) 10 according to an embodiment of the present disclosure.

As depicted in FIG. 1, the MFD 10 has an overall shape of a six-sided rectangular box and contains a printer 11, in which an image can be recorded on a recording sheet 12 (see FIG. 2) in an inkjet recording method, in a lower position thereof. In other words, the MFD 10 is equipped with a printing function. The MFD 10 is a multi-functional device having a plurality of functions, including, for example, a facsimile transmission/receiving function and a copier function, additionally to the printing function. The printer 11 is capable of recording an image on either side or both sides of the recording sheet 12 in, for example, an inkjet printing method. The method to record an image on the recording sheet 12 may not necessarily be limited to inkjet printing but may be, for example, an electro-photographic method.

Figure 2:
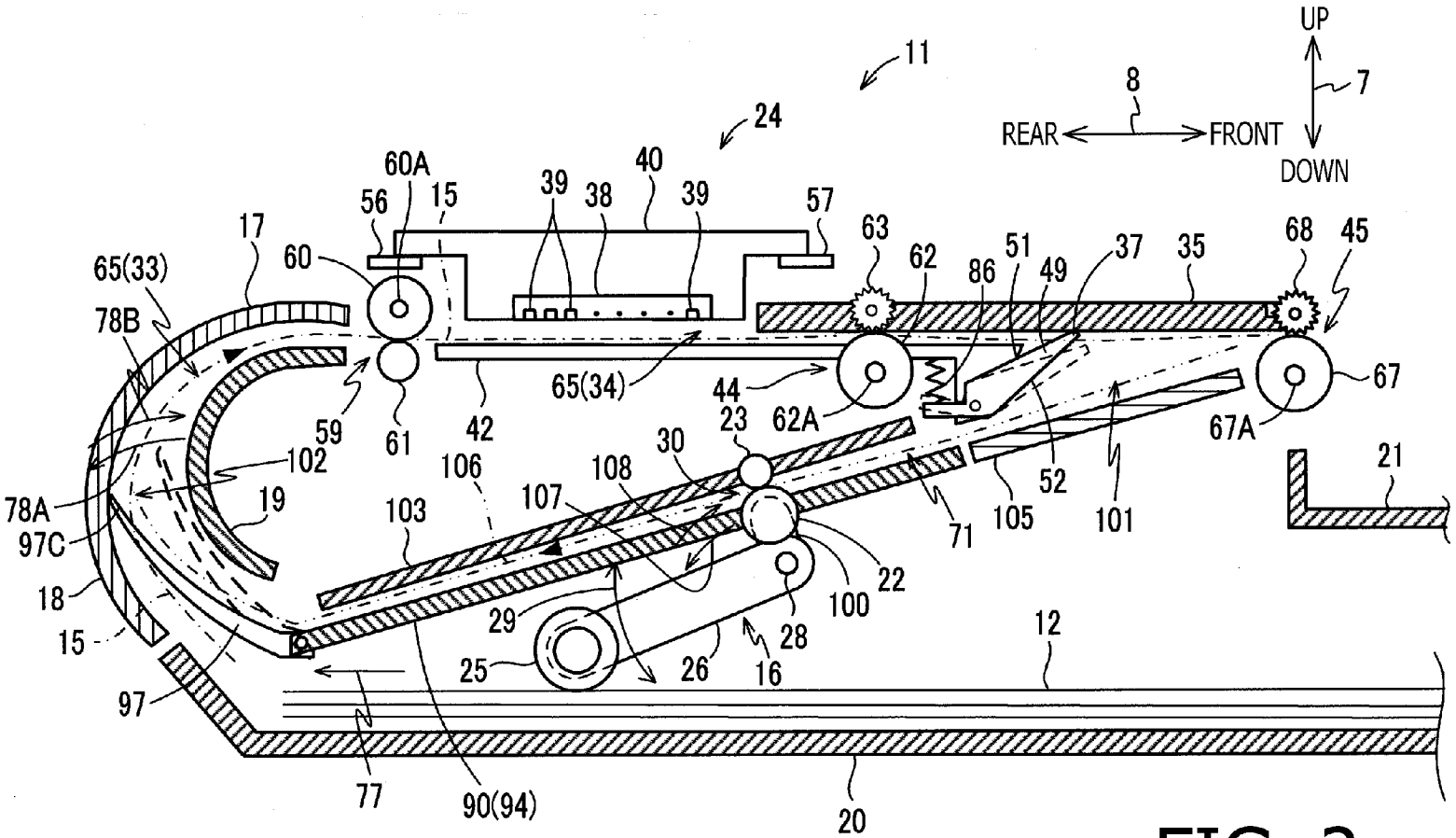
FIG. 2 is a cross-sectional side view of an internal structure of a printer 11 in the MFD 10 according to the embodiment of the present disclosure.

The printer 11 includes a chassis 14. On a front face 75 of the chassis 14, formed is the opening 13. As shown in FIG. 2, the chassis 14 contains a main conveyer path 65, an inverting path 71, guide rails 56, 57, and lateral frames 53 (see FIG. 8). The chassis 14 is an exterior cover, which may accommodate parts and components for the printer 11 therein, and is placed over a base member 90, which will be described later in detail.

[Feeder Tray 20]

As depicted in FIG. 1, a feeder tray 20 is installable in and removable from the chassis 14 through a lower area of the opening 13. As depicted in FIG. 2, the recording sheets 12 may be stored in and supported by the feeder tray 20. A sheet ejection tray 21 may be supported at an upper-frontward position in the feeder tray 20. On an upper plane of the sheet ejection tray 12, the recording sheets 12 with images formed thereon may be placed.

[Feeder Unit 16]

As depicted in FIG. 2, a feeder unit 16 is arranged in an upper position with respect to the feeder tray 20 in the chassis 14. The feeder unit 16 includes a feeder roller 25, a feeder arm 26, and a drive shaft 28.

The feeder roller 25 is rotatably attached to one end of the feeder arm 26. The feeder roller 25 is rotatable by a driving force generated in a conveyer motor 109 (see FIG. 4) and transmitted through a drive-force transmission system 70, which will be described later in detail. For example, the feeder roller 25 may rotate in a normal direction to feed the recording sheets 12 being supported on the feeder tray 20 in a feeding direction 77, i.e., rearward, when the conveyer motor 109 is in reverse rotation.

The feeder arm 26 is pivotable about the drive shaft 28 upward and downward, along a direction indicated by an arrow 29, to be closer to or farther from the recording sheets 12 placed on the feeder tray 20. The feeder arm 26 is pivotably supported at one end thereof on an upstream side with regard to the feeding direction 77 by the drive shaft 28, which is supported by the base member 90. The feeder arm 26 is arranged to longitudinally extend from the end thereof on the upstream side with regard to the feeding direction 77 to incline lower-rearward. The feeder arm 26 is urged downward by itself due to the effect of gravity and/or resilient force provided by, for example, a spring.

Thus, the feeder arm 26 is rotatably supported by the drive shaft 28 at the one end on the upstream side with regard to the feeding direction 77 and supports the feeder roller 25 rotatably at the other end on a downstream side with regard to the feeding direction 77. The feeder arm 26 further supports a plurality of gears, including a sun gear 138 and gears 130, 131, 134, 135 (see FIG. 4), which are in a second transmission 182 included in the drive-force transmission system 70. The drive-force transmission system 70 and the second transmission 182 will be described later in detail.

[Main Conveyer Path 65]

As depicted in FIG. 2, the main conveyer path 65 is formed in the chassis 14 to extend from a rearward end of the feeder tray 20. The main conveyer path 65 includes a curved path 33 and a linear path 34. The curved path 33 is formed to curve upward from the rearward end of the feeder tray 20 and is connected with the linear path 34 at a rearward position with respect to a conveyer roller pair 59, which will be described later in detail. The linear path 34 is formed to extend from the position, at which the curved path 33 and the linear path 34 are connected with each other, to a reversible roller pair 45, which will be described later in detail, along the front-rear direction 8.

A form of the curved path 33 is defined by an outer guide member 18 and an inner guide member 19, which are spaced apart from each other for a predetermined amount of clearance to face each other along the front-rear direction 8. The linear path 34 is formed at a position corresponding to the recording unit 24, and a form of a part of the linear path 34 is defined by the recording unit 24 and a platen 42, which are spaced apart from each other for a predetermined amount of clearance to face each other along the vertical direction 7. Further, at a frontward position with respect to the recording unit 24, a form of another part of the linear path 34 is defined by a first upper guide member 35, the platen 42, an ejection roller 62, a spur roller 63, a first flapper 49, a reversible roller 67, and a spur roller 68. The first upper guide member 35 and the platen 42, the ejection roller 62 and the spur roller 63, the first upper guide member 35 and the first flapper 49, and the reversible roller 67 and the spur roller 68 are respectively arranged to face with each other. The first upper guide member 35 and the platen 42, and the first upper guide member 35 and the first flapper 49 are respectively arranged to be spaced apart from each other. Thus, the above-described mutually facing members and parts form at least a part of the main conveyer path 65.

The recording sheets 12 placed on the feeder tray 20 are fed by the feeder roller 25 to the curved path 33 and conveyed through the curved path 33 and the linear path 34 along a main conveying direction 15, which is indicated by a dotted line in FIG. 2. In other words, the feeder roller 25 conveys the recording sheets 12 supported on the feeder tray 20 along the main conveyer path 65 in the main conveying direction 15.

[Recording Unit 24]

As depicted in FIG. 2, the recording unit 24 is disposed in an upper position with respect to the linear path 34. In a lower position with respect to the linear path 34, and in a position to face with the recording unit 24 and the first upper guide member 35, disposed is the platen 42, which supports the recording sheet 12 in the main conveyer path 65. The platen 42 is supported by the pair of lateral frames 53 (see FIG. 8).

The recording unit 24 includes a carriage 40 and a recording head 38. The carriage 23 is movable along the widthwise direction 9 on the guide rails 56, 57 (see FIG. 9), which are arranged to be spaced apart from each other along the front-rear direction 8.

The guide rails 56, 57 are made of metal, such as stainless steel, and are each formed in a shape of a flat bar elongated along the widthwise direction 9, which intersects with the main conveying direction 15. The guide rails 56, 57 are supported by the pair of lateral frames 53, at widthwise ends thereof The pair of lateral frames 53 are made of metal, such as stainless steel, and are each formed in a shape of a plate spreading along the main conveying direction 15, i.e., along the front-rear direction 8. The lateral frames 53 are arranged on rightward and leftward positions of a conveyable range, in which the recording sheets 12 in various or different sizes may be conveyed, in the linear path 34. In other words, the lateral frames 53 are arranged on both widthwise sides of the main conveyer path 65.

The recording head 38 is mounted on the carriage 40. On a bottom plane of the recording head 38, formed are a plurality of nozzles 39. As ink is supplied to the recording head 38 from an ink cartridge (not shown), the recording head 38 discharges minute droplets of the ink through the nozzles 39. As the carriage 40 moves in the widthwise direction 9, the recording head 38 discharges the ink droplets at the recording sheet 12, which is conveyed by the feeder roller 25 and a conveyer roller 60 and is supported by the platen 42. Thus, an image is formed in the ink on the recording sheet 12. The conveyer roller 60 will be described later in detail.

[Conveyer Roller Pair 59, Ejection Roller Pair 44, and Reversible Roller Pair 45]

As depicted in FIG. 2, the conveyer roller pair 59 is disposed at a position in the linear path 34 on an upstream side of the recording unit 24 and on a downstream side of a merging point 102, which will be described later, with regard to the main conveying direction 15. The ejection roller pair 44 is disposed at a position in the linear path 34 on the downstream side of the recording unit 24 with regard to the main conveying direction 15. The reversible roller pair 45 is disposed at a position in the linear path 34 on a downstream side of a branch point 101, which will be described later, with regard to the main conveying direction 15.

The conveyer roller pair 59 includes the above-mentioned conveyer roller 60, which is disposed on an upper side of the linear path 34, and a pinch roller 61, which is disposed on a lower side of the linear path 34 to face with the conveyer roller 60. The ejection roller pair 44 includes an ejection roller 62, which is disposed on the lower side of the linear path 34, and a spur roller 63, which is disposed on the upper side of the linear path 34 to face with the ejection roller 62. The reversible roller pair 45 includes the reversible roller 67, which is disposed on the lower side of the linear path 34, and the spur roller 68, which is disposed on the upper side of the linear path 34 to face with the reversible roller 67.

The pinch roller 61 is urged toward the conveyer roller 60 by an urging member (not shown) such as a coil spring. The ejection roller 62 is urged toward the spur roller 63 by an urging member (not shown) such as a coil spring. The reversible roller 67 is urged toward the spur roller 68 by an urging member (not shown) such as a coil spring. Thus, the conveyer roller pair 59, the ejection roller pair 44, and the reversible roller pair 45 can nip the recording sheet 12 in the main conveyer path 65.

The conveyer roller 60, the ejection roller 62, and the reversible roller 67 are rotatably supported by the pair of lateral frames 53. The conveyer roller 60, the ejection roller 62, and the reversible roller 67 are driven by the driving force from the conveyer motor 109 (see FIG. 4). When the conveyer motor 109 is in normal rotation, the conveyer roller 60, the ejection roller 62, and the reversible roller 67 rotate in the normal direction, and when the conveyer motor 109 is in reverse rotation, the conveyer roller 60, the ejection roller 62, and the reversible roller 67 rotate in the reverse direction. Transmission of the driving force from the conveyer motor 109 to the conveyer roller 60, the ejection roller 62, and the reversible roller 67 will be described later in detail.

The pinch roller 61, the spur roller 63, and the spur roller 68 are rotated by the rotation of the conveyer roller 60, the ejection roller 62, and the reversible roller 67, respectively.

While the recording sheet 12 is nipped by one or more of the conveyer roller pair 59, the ejection roller pair 44, and the reversible roller pair 45, and when the conveyer roller 60, the ejection roller 62, and the reversible roller 67 rotate in the normal direction, the recording sheet 12 is conveyed in the main conveying direction 15. On the other hand, when the conveyer roller 60, the ejection roller 62, and the reversible roller 67 rotate in the reverse direction, the nipped recording sheet 12 is conveyed in a reverse direction opposite from the main conveying direction 15.

[Inverting Path 71]

As depicted in FIG. 2, the inverting path 71 is formed in a lower position with respect to the linear path 34 and an upper position with respect to the feeder roller 25. The inverting path 71 is branched from the linear path 34 at the branch point 101, which is on the downstream side of the ejection roller pair 44 and on the upstream side of the reversible roller pair 45 with regard to the main conveying direction 15. More specifically, the inverting path 71 may be formed to branch from the liner path 34 to extend on a side of the platen 42 (e.g., downward) rather than a side of the first upper guide member 35 (e.g., upward), with regard to the vertical direction 7, along which the first upper guide 35 and the platen 42 face each other.

In the inverting path 71, the recording sheet 12 is conveyed in an inverting direction 106, which is indicated by a double-dotted arrow in FIG. 2, from the branch point 101 toward the merging point 102.

The inverting path 71 is merged with the curved path 33 at the merging point 102, which is on the upstream side of the conveyer roller pair 59 with regard to the main conveying direction 15. A form of the inverting path 71 are defined by the first flapper 49, a lower guide member 105, a second upper guide member 103, the base member 90, an inner guide member 19, and a second flapper 97. The first flapper 49 and the lower guide member 105, the second upper guide member 103 and the base member 90, and the inner guide member 19 and the second flapper 97 are respectively arranged to face each other and to be spaced apart from each other.

The first flapper 49, the second upper guide member 103, and the inner guide member 19 define a form of an upper side of the inverting path 71. The lower guide member 105, the base member 90, and the second flapper 97 define a form of a lower side of the inverting path 71. The first flapper 49 is disposed in a position on an upstream side of the second upper guide member 103 with regard to the inverting direction 106. The second upper guide member 103 is disposed in a position on an upstream side of the inner guide member 19 with regard to the inverting direction 106. The lower guide member 105 is disposed in a position on an upstream side of the base member 90 with regard to the inverting direction 106. The base member 90 is disposed in a position on an upstream side of the second flapper 97 with regard to the inverting direction 106.

[Return-Conveyer Unit 31]

A return-conveyer unit 31 includes, as depicted in FIG. 2, a return-conveyer roller pair 30, a return-conveyer arm 100, and the drive shaft 28.

The return-conveyer roller pair 30 is disposed along the inverting path 71. The return-conveyer roller pair 30 includes a return-conveyer roller 22, which is disposed on a lower side of the inverting path 71, and a driven roller 23, which is disposed on an upper side of the inverting path 71 to face with the return-conveyer roller 22. The driven roller 23 is rotated by rotation of the return-conveyer roller 22.

The return-conveyer arm 100 is pivotably supported by the drive shaft 28 at one end on the upstream side with regard to the inverting direction 106. Therefore, the return-conveyer arm 100 is pivotable about the drive shaft 28 in a direction 107 and a direction 108. When the drive shaft 28 rotates in the direction 107, the return-conveyer roller 22 is separated away from the driven roller 23, and when the drive shaft 28 rotates in the direction 108, the return-conveyer roller 22 is moved to be closer to the driven roller 23. The return-conveyer arm 100 is arranged to longitudinally extend from the end thereof on the upstream side with regard to the inverting direction 106 to incline upper-rearward. The return-conveyer arm 100 supports the return-conveyer roller 22 rotatably at the other end on a downstream side with regard to the inverting direction 106. Further, the return-conveyer arm 100 supports a plurality of gears 147, 148, which are in a third transmission 140 included in the drive-force transmission system 70, rotatably.

The return-conveyer arm 100 is urged by an urging member (not shown), which may include, for example, a torsion spring, in the direction 108 so that the return-conveyer roller 22 contacts the driven roller 23. Thus, the return-conveyer roller pair 30 may nip the recording sheet 12 in the inverting path 71.

The return-conveyer roller 22 is rotated in a normal direction by the driving force transmitted from the conveyer motor 109 rotating in either the normal or reverse direction, through the drive-force transmission system 70. Thereby, the return-conveyer roller pair 30 may convey the nipped recording sheet 12 in the inverting direction 106 along the inverting path 71.

[Drive-Force Transmission System 70]

The drive-force transmission system 70 transmits the driving force generated in the conveyer motor 109 to movable parts, which include the feeder roller 25, the conveyer roller 60, the ejection roller 62, the reversible roller 67, and the return-conveyer roller 22. The drive-force transmission system 70 may include one or more of a gear, a pulley, an endless belt, a planet-gear system including a pendulum-gear system, and a one-way clutch.

The drive-force transmission system 70 includes, as depicted in FIGS. 4A-4B and 5A-5B, a pulley 111, which is integrally rotatable with a shaft (not shown) of the conveyer motor 109, a pulley 112, which is integrally rotatable with a shaft 60A of the conveyer roller 60, and an endless belt 113, which is strained around the pulleys 111, 112. Thereby, the normal rotation of the conveyer motor 109 is transmitted to the conveyer roller 60 to rotate the conveyer roller 60 in the normal direction, and the reverse rotation of the conveyer motor 109 is transmitted to the conveyer roller 60 to rotate the conveyer roller 60 in the reverse direction.

The drive-force transmission system 70 further includes, as depicted in FIGS. 4A-4B and 5A-5B, a switching system 170, which switches transmission destinations of the driving force from the conveyer motor 109, and first, second, third and fourth transmissions 181, 182, 140, 149, which transmit the driving force from the conveyer motor 109 to the feeder roller 25, the ejection roller 62, the reversible roller 67, and the return-conveyer roller 22 respectively, through the shaft 60A of the conveyer roller 60. In this regard, however, a transmitting system to transmit the driving force from the conveyer motor 109 to the feeder roller 25, the ejection roller 62, the reversible roller 67, and the return-conveyer roller 22 may not necessarily be limited to the exemplary configuration described below.

[Switching System 170]

Conditions to transmit the driving force from the conveyer motor 109 through the conveyer roller 60 may be switched by the switching system 170 between a first condition, in which the driving force is transmitted to the feeder roller 25, and a second condition, in which the driving force is not transmitted to the feeder roller 25 but to the return-conveyer roller 22. The switching system 170 may be arranged on a rightward position with respect to the platen 42. As depicted in FIG. 3, the switching system 170 includes a switch gear 171, two (2) receiver gears 172A, 172B, a holder 173, a presser 175, and a switch lever 176.

The switch gear 171 is rotatable about a shaft 174 and is movable along an axial direction of the shaft 174, e.g., along the widthwise direction 9. The driving force from the conveyer motor 109 is transmitted to the switch gear 171 through the shaft 60A of the conveyer roller 60 and a gear 177 (see FIG. 4). The receiver gears 172A, 172B are coaxially rotatable about an axis, which extends along the widthwise direction 9, in a lower position with respect to the shaft 174. The receiver gears 172A, 172B are engageable with the switch gear 171. Thus, the switch gear 171 is movable in the widthwise direction 9 to be engaged with one of the receiver gears 172A, 172B. The receiver gear 172A is a gear to transmit the driving force from the conveyer motor 109 to the feeder roller 25. The receiver gear 172B is a gear to transmit the driving force from the conveyer motor 109 to the ejection roller 62, the reversible roller 67, and the return-conveyer roller 22.

Figure 3A:
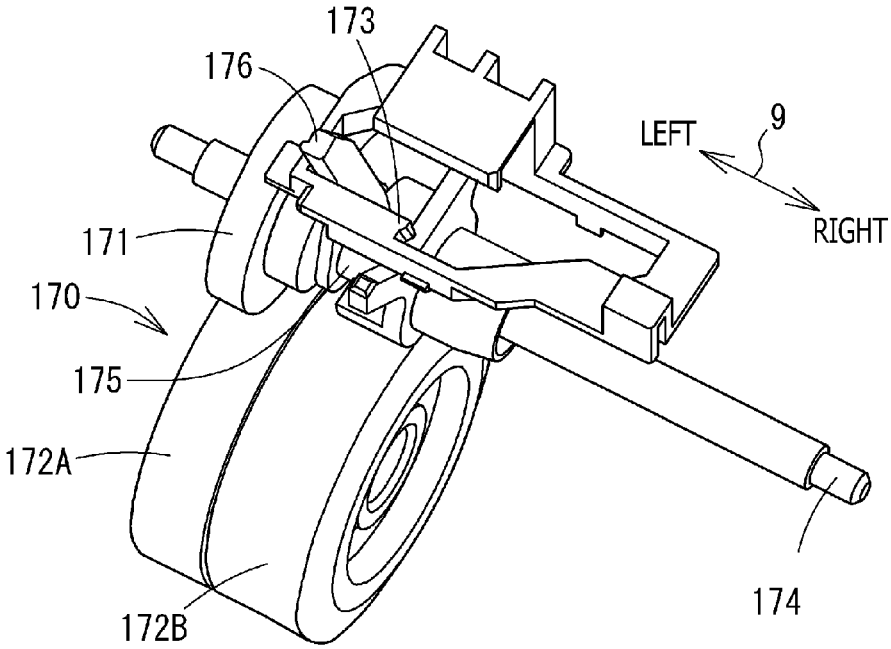
FIG. 3A is a perspective view of a switching system 170 being in a first condition in the MFD 10 according to the embodiment of the present disclosure.

The presser 175 is disposed in a rightward position with respect to the switch gear 171, and the shaft 174 is placed to penetrate axially through the presser 175 so that the presser 175 is slidable on the shaft 174 in the widthwise direction 9. The switch lever 176 is formed to protrude upward from the presser 175 to extend through the holder 173 to reach a movable path of the carriage 40 and beyond the conveyable range of the recording sheet 12. The switch gear 171 is urged rightward by a first spring (not shown), and the presser 175 is urged leftward by a second spring (not shown). In this regard, an urging force of the second spring is greater than an urging force of the first spring; therefore, the switch gear 171 and the presser 175 shown in FIGS. 3A-3B are urged leftward against the rightward urging force of the first spring.

Figure 3B:
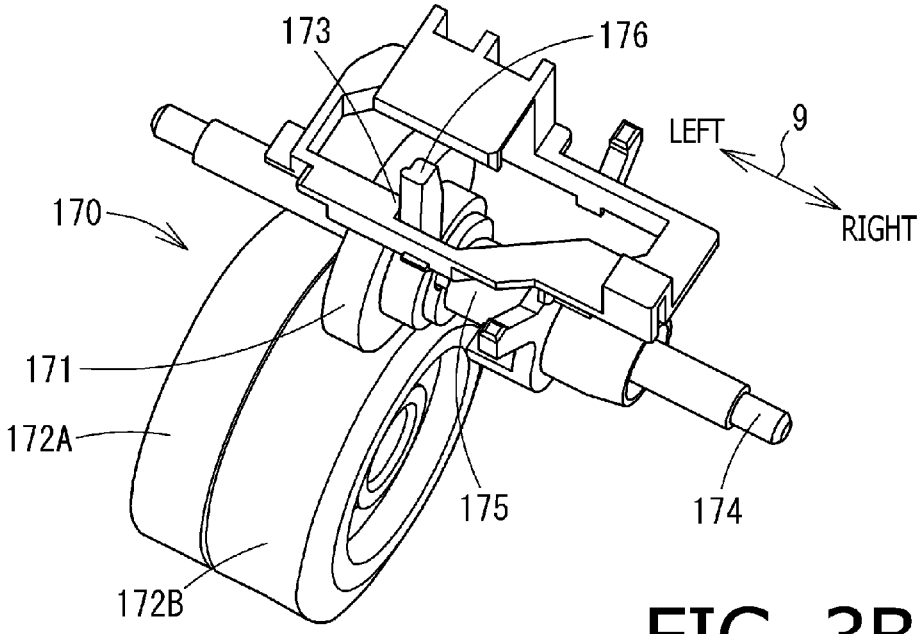
FIG. 3B is a perspective view of the switching system 170 being in a second condition in the MFD 10 according to the embodiment of the present disclosure.

The switch lever 176 being in a first position (see FIG. 3A) may be hit by the carriage 40 moving rightward to move the presser 175 rightward to a second position (see FIG. 3B). In this regard, the switch gear 171 being urged rightward by the first spring moves rightward according to the movement of the presser 175. Meanwhile, the switch lever 176 moved to a rightward end of the holder 173 by the carriage 40 is, as the carriage 40 moves away from the switch lever 176, moves back to the first position by the urging force of the second spring. Thus, the switching system 170 is switchable between the first condition and the second condition alternately by the carriage 40 reciprocating in the widthwise direction 9.

While the switch lever 176 is maintained in the first position by the holder 173, the switch gear 171 is engaged with the receiver gear 172A. On the other hand, while the switch lever 176 is maintained in the second position by the holder 173, the switch gear 171 is engaged with the receiver gear 172B.

[First Transmission 181]

The first transmission 181 transmits the driving force, which is transmitted from the conveyer motor 109 through the shaft 60A of the conveyer roller 60, to the ejection roller 62 and the reversible roller 67. The first transmission 181 includes, as shown in FIGS. 4A-4B, intermeshing gears 115, 116, pulleys 117, 118, 119, 119, 120, endless belts 121, 122, and a one-way clutch 123.

The gear 115 is meshed with the gear 116 and is rotatable integrally with the shaft 60A of the conveyer roller 60. The gear 116 and the pulley 117 are integrally and coaxially rotatable. The pulley 118 is attached to a shaft 62A of the ejection roller 62 through the one-way clutch 123. The pulley 119 is integrally rotatable with the shaft 62A of the ejection roller 62. The pulley 120 is integrally rotatable with a shaft 67A of the reversible roller 67. The endless belt 121 is strained around the pulleys 119, 120. The one-way clutch 123 transmits the driving force of the conveyer motor 109 in the normal rotation, which is transmitted to the pulley 118, to the shaft 62A of the ejection roller 62 and to the pulley 119. Meanwhile, the one-way clutch 123 does not transmit the driving force of the conveyer motor 109 in the reverse rotation, which is transmitted to the pulley 118, to the shaft 62A of the ejection roller 62 or to the pulley 119.

Therefore, as depicted in FIG. 4A, the driving force of the conveyer motor 109 in the normal rotation transmitted through the first transmission 181 causes the ejection roller 62 and the reversible roller 67 to rotate in the normal direction. Meanwhile, as depicted in FIG. 4B, the driving force of the conveyer motor 109 in the reverse rotation transmitted through the first transmission 181 is not transmitted to the ejection roller 62 or the reversible roller 67.

[Second Transmission 182]

The second transmission 182 transmits the driving force, which is transmitted from the conveyer motor 109 through the shaft 60A of the conveyer roller 60 and the switching system 170 in the first condition, to the feeder roller 25. The second transmission 182 includes, as depicted in FIGS. 4A-4B, gears 126, 127, 128, 129, 130, 131, 134, 135, pulleys 132, 133, an endless belt 136, a sun gear 138, a pendulum gear 139, and an arm 125.

The gear 126 is meshed with the receiver gear 172A and the gear 127. The gear 127 and the pulley 132 are rotatable integrally and coaxially. The gear 128 and the pulley 133 are rotatable integrally and coaxially. The gear 129 is meshed with the gear 128. The gear 129 and the sun gear 138 are fixed to the drive shaft 28 of the return-conveyer unit 31. Thereby, the sun gear 138 is rotatable integrally and coaxially with the gear 129. The pendulum gear 139 is meshed with the sun gear 138 and is movable to be meshed with or separated from the gear 130. The arm 125 is pivotably supported by the sun gear 138 at one end and supports the pendulum gear 139 to be rotatable and revolvable at the other end. Thus, the sun gear 138, the pendulum gear 139, and the arm 125 form a pendulum gear system. The gear 130 is meshed with the gear 131. The gear 131 is meshed with the gear 134. The gear 134 is meshed with the gear 135. The gear 135 is rotatable integrally and coaxially with the feeder roller 25. Therefore, the feeder roller 25 is rotatable by rotation of the drive shaft 28.

The pendulum gear 139 is rotated by the rotation of the sun gear 138 and revolves about the sun gear 138. The pendulum gear 139 is, as depicted in FIG. 4A, moved to be separated from the gear 130 when the driving force of the conveyer motor 109 in the normal rotation is transmitted thereto. Meanwhile, as depicted in FIG. 4B, the pendulum gear 139 is meshed with the gear 130 when the driving force of the conveyer motor 109 in the reverse rotation is transmitted thereto. Thus, the second transmission 182 does not transmit the driving force from the conveyer motor 109 in the normal rotation to the feeder roller 25. On the other hand, the second transmission 182 transmits the driving force from the conveyer motor 109 in the reverse rotation to the feeder roller 25 to rotate the feeder roller 25 in the normal direction.

[Third Transmission 140]

The third transmission 140 transmits the driving force, which is transmitted from the conveyer motor 109 through the shaft 60A of the conveyer roller 60 and the switching system 170 in the second condition, to the return-conveyer roller 2. The third transmission 140 includes, as depicted in FIGS. 5A-5B, a sun gear 141, pendulum gears 142, 143, arms 144, 145, and a gear train 146, and gears 147, 148.

The sun gear 141 is meshed with the receiver gear 172B. The pendulum gear 142 is meshed with the sun gear 141 and is movable to be meshed with or separated from the gear 146B. The arm 144 is pivotably supported by the sun gear 141 at one end and supports the pendulum gear 142 to be rotatable and revolvable at the other end. The arm 145 is pivotably supported by the sun gear 141 at one end and supports the pendulum gear 143 to be rotatable and revolvable at the other end. Thus, the sun gear 141, the pendulum gears 142, 143, and the arms 144, 145 form a pendulum gear system. The gear train 146 includes a plurality of, or for example, an even number (e.g., 6) of, gears 146A-146F, in which adjoining gears are intermeshed. The gear 147 and the gear 146F are both fixed to the drive shaft 28. Thereby, the gear 147 is rotatable integrally and coaxially with the gear 146F. The gear 148 is meshed with the gear 147 and is rotatable integrally and coaxially with a shaft (not shown) of the return-conveyer roller 22. Thus, the return-conveyer roller 22 is rotated by the rotation of the drive shaft 28.

As depicted in FIG. 5A, by the driving force from the conveyer motor 109 in the normal rotation being transmitted to the sun gear 141, the pendulum gear 142 is separated from the gear 146A, and the pendulum gear 143 is meshed with the gear 146B. Thus, the driving force from the conveyer motor 109 rotating in the normal direction is transmitted through a part of the gear train 146, which includes an odd number of (e.g., 5) gears 146B-146F, to the return-conveyer roller 22. Meanwhile, as depicted in FIG. 5B, by the driving force from the conveyer motor 109 in the reverse rotation transmitted to the sun gear 141, the pendulum gear 142 is meshed with the gear 146A, and the pendulum gear 143 is separated from the gear 146B. Thus, the driving force from the conveyer motor 109 rotating in the reverse direction is transmitted through the gear train 146, which includes the even number of (e.g., 6) gears 146A-146F, to the return-conveyer roller 22. Accordingly, the third transmission 140 transmits the driving force from the both normal and reverse rotations of the conveyer motor 109 to the return-conveyer roller 22 to rotate the return-conveyer roller 22 in the normal direction.

In this regard, when the driving force from the conveyer motor 109 is transmitted to the return-conveyer roller 22, gears fixed to the drive shaft 28 may rotate clockwise in FIGS. 4A-5B. Meanwhile, the sun gear 138 in the second transmission 182 rotates in the direction to separate the pendulum gear 139 away from the gear 130 (see FIG. 4A). Thus, the driving force from the conveyer motor 109 is transmitted to the return-conveyer roller 22 through the third transmission 140 but not to the feeder roller 25, which therefore does not rotate.

[Fourth Transmission 149]

The fourth transmission 149 transmits the driving force, which is transmitted from the conveyer motor 109 through the shaft 60A of the conveyer roller 60 and the switching system 170 in the second condition, to the ejection roller 62 and the reversible roller 67. The fourth transmission 149 includes, as depicted in FIGS. 5A-5B, a gear train 150, a sun gear 151, a pendulum gear 152, an arm 153, and a gear 154.

The gear train 150 includes a plurality of gears 150A-150D, in which adjoining gears intermesh with each other. The gear 150A is meshed with the receiver gear 172B. The sun gear 151 is meshed with the gear 150D. The pendulum gear 152 is meshed with the sun gear 151 and is movable to be meshed with or separated from the gear 154. The arm 153 is pivotably supported by the sun gear 151 at one end and supports the pendulum gear 152 to be rotatable and revolvable at the other end. The gear 154 is rotatable integrally with the shaft 62A of the ejection roller 62.

As depicted in FIG. 5A, by the driving force from the conveyer motor 109 rotating in the normal direction transmitted to the sun gear 151, the pendulum gear 152 is separated from the gear 154. Meanwhile, as depicted in FIG. 5B, by the driving force from the conveyer motor 109 rotating in the reverse direction transmitted to the sun gear 151, the pendulum gear 152 is meshed with the gear 154. Further, the ejection roller 62 and the reversible roller 67 are rotated integrally by the pulleys 119, 120, and the endless belt 122. Accordingly, the fourth transmission 149 does not transmit the driving force from the conveyer motor 109 rotating in the normal direction to the ejection roller 62 or the reversible roller 67 but transmits the driving force from the conveyer motor 109 rotating in the reverse direction to the ejection roller 62 and the reversible roller 67 to rotate the ejection roller 62 and the reversible roller 67 in the reverse direction.

[First Flapper 49]

As depicted in FIG. 2, the first flapper 49 is disposed in the linear path 34 between the ejection roller pair 44 and the reversible roller pair 45. The first flapper 49 may be disposed, in particular, at the branch point 101. The first flapper 49 may be arranged to face with the first upper guide member 35 along the vertical direction 7.

The first flapper 49 is supported by the platen 42 to be pivotable between a first condition, which is indicated by solid lines in FIG. 2, and a second condition, which is indicated by broken lines in FIG. 2. When in the first condition, the flapper 49 may contact the first upper guide member 35 to close the main conveyer path 65. The first flapper 49 in the second condition is in a lower position with respect to the first flapper 49 in the first condition, and when in the second condition, the flapper 49 may be separated from the first upper guide member 35 to form a clearance between the flapper 49 and the first upper guide member 35 so that the recording sheet 12 being conveyed in the main conveying direction 12 is allowed to pass through the clearance. A pivotable end, or a frontward end 37, of the first flapper 49 in the second condition is in a lower position with respect to the frontward end 37 of the first flapper 49 in the first condition. The first flapper 49 may not necessarily be supported by the platen 42 but may be pivotably supported by another member, such as a frame (not shown) of the printer 11.

As depicted in FIG. 2, the first flapper 49 is urged by a coil spring 86 to place the frontward end 37 upward. The coil spring 86 is coupled to the first flapper 49 at one end and to the platen 42 at the other end. The first flapper 49 being urged by the coil spring 86 may be in the first condition, in which the frontward end 37 thereof may contact the first upper guide member 35. According to the present embodiment, the first flapper 49 is in the first condition when the coil spring 86 urges the first flapper 49 and when no other force from any parts or components in the printer 11 is applied to the first flapper 49.

[Base Member 90]

The base member 90 forms a lower part of the printer 11 and may be made integrally of resin, such as poly butylene terephthalate (PBT) and acrylonitrile butadiene styrene (ABS).

As depicted in FIG. 6, the base member 90 includes a rightward section 91, a leftward section 92, a frontward section 93, and a rearward section 94. The rightward section 91 forms a lower-rightward part of the printer 11. The leftward section 92 forms a lower-leftward part of the printer 11. The frontward section 93 connects frontward ends of the rightward section 91 and the leftward section 92. The rearward section 94 connects rearward ends of the rightward section 91 and the leftward section 92.

Bottoms of the rightward section 91 and the leftward section form a bottom plane of the MFD 10, by which the MFD 10 may be placed on, for example, a desktop.

On a front side of the rearward section 94, formed are through-holes 95, which are open in the widthwise direction 9. In the through-holes 95, the drive shaft 28 is inserted (see FIG. 7). Thus, the drive shaft 28 is rotatably supported by the rearward section 94 through bearings (not shown). In other words, the drive shaft 28 is rotatably supported by the base member 90. Meanwhile, as has been described above, the drive shaft 28 supports the feeder roller 25 through the feeder arm 26. Further, the drive shaft 28 supports the reverse-conveyer roller 22 through the return-conveyer arm 100. Therefore, the base member 90 supports the feeder arm 26, the feeder roller 25, the return-conveyer arm 100, and the return-conveyer roller 22 through the drive shaft 28. Further, as depicted in FIG. 7, the base member 90 supports the outer guide member 18 at a rearward position with respect to the rearward section 94.

As depicted in FIG. 6, on an upper side of the rearward section 94, formed are a plurality of ribs 96, which are spaced apart from one another across the widthwise direction 9 and elongated along the inverting direction 106. The ribs 96 are arranged in a lower position with respect to the second upper guide member 103 to face with the second upper guide member 103 along the vertical direction 7. A virtual surface spreading on protrusive edges of the ribs 96 defines a form of a part of a bottom of the inverting path 71. In particular, the virtual surface defines the bottom of the inverting path 71 at downstream side of the lower guide member 105 with regard to the inverting direction 106. In other words, the virtual surface guides the recording sheet 12 on the ribs 96 along the inverting path 71. The ribs 96 are reinforced by ribs 99, which are formed to be shorter than the ribs 96 and elongated through the ribs 96 along the widthwise direction 9.

As depicted in FIG. 8, the rightward section 91 supports one of the paired lateral frames 53 on the right, and the leftward section 91 supports the other one of the paired lateral frame 53 on the left. Meanwhile, as has been described above, the paired lateral frames 53 support the recording unit 24 through the guide rails 56, 57; the platen 42; and the conveyer roller 60, the ejection roller 62, and the reversible roller 67 rotatably. In other words, the base member 90 supports the recording unit 24, the platen 42, and the rollers including the conveyer roller 60, the ejection roller 62, the reversible roller 67, the feeder roller 25, and the return-conveyer roller 22.

[Second Flapper 97]

As depicted in FIGS. 2 and 7, the printer 11 includes a second flapper 97. The second flapper 97 is disposed at the merging point 102. The rearward section 94 in the base member 90 supports the second flapper 97 at a rear end thereof pivotably so that the second flapper 97 is pivotable in directions indicated by an arrow 78A and an arrow 78B. The arrow 78A indicates a direction, in which the second flapper 97 pivots to be closer to the outer guide member 18. The arrow 78B indicate a direction, in which the second flapper 97 pivots to be closer to the inner guide member 19.

The second flapper 97 is supported by the rearward section 94. More specifically, as depicted in FIG. 6, on the rear end of the rearward section 94, formed is a shaft 98, which is elongated along the widthwise direction 9. Meanwhile, as depicted in FIGS. 10A-10B, the second flapper 97 is formed to have a first protrusive claw 54A and a second protrusive claw 54B. The first protrusive claw 54A and the second protrusive claw 54B are formed to protrude to curve from an edge of the second flapper 97 on an upstream side with regard to the inverting direction 106 and are arranged to interpose the shaft 98 in there-between along the front-rear direction 8. With the shaft 98 thus being clutched by the first protrusive claw 57 and the second protrusive claw, the second flapper 97 is pivotably by the base member 90.

As depicted in FIG. 2, the second flapper 97 is, when the second flapper 97 is supported by the base member 90, formed to curve so that a rearward face is on an outer side of the curvature and a frontward face is on an inner side of the curvature. As depicted in FIG. 10A, on an outward face of the second flapper 97, formed are a plurality of ribs 97A, which are spaced apart from one another across the widthwise direction 9. The ribs 97A stretch to curve similarly to a surface of the outer guide member 18 on the side of the curved path 33. As depicted in FIG. 10B, at a widthwise center and widthwise ends of the second flapper 97 on an inward face on the inner side of the curve, formed are curved surfaces 97B, which curve similarly to a surface of the inner guide member 19 on the side of the curved path 33.

The second flapper 97 is movable to pivot between a first position, which is indicated by solid lines in FIG. 2, and a second position, which is indicated by broken lines in FIG. 2. The second flapper 97 in the first position and the inner guide member 19 face each other across a predetermined amount of clearance. In this regard, the curved surfaces 97B and the outer side of the curve of the inner guide member 19 define a form of a part of the inverting path 71. Meanwhile, the second flapper 97 in the second position and the outer guide member 18 face each other across a predetermined amount of clearance. In this regard, a virtual surface spreading on protrusive edges of the ribs 97A and the inner surface of the curve of the outer guide member 18 define a form of a part of the curved path 33.

As depicted in FIG. 2, the second flapper 97 is, when no force from any parts or components in the printer 11 is applied to the second flapper 97, maintained at the first position by itself due to the effect of gravity. In the meantime, a pivotable end 97C of the second flapper 97 in the first position contacts the outer guide member 18.

[Behaviors to Record Images on Both Sides of the Recording Sheet 12]

Behaviors of the printer 11, when images are formed on both sides of the recording sheet 12 supported by the feeder tray 20, will be described below.

First, the switching system 170 is placed in the first condition. Next, the conveyer motor 109 is driven to rotate in the reverse direction. Thereby, the driving force from the conveyer motor 109 rotating in the reverse direction is transmitted through the second transmission 182 to the feeder roller 25. The feeder roller 25 rotates in the normal direction, and the recording sheet 12 on the feeder tray 20 is conveyed to the curved path 33.

Meanwhile, the second flapper 97 is maintained at the first position by itself due to the effect of gravity. Therefore, a leading end of the recording sheet 12 being conveyed to the curved path 33 contacts the second flapper 97. Further to the contact with the recording sheet 12, the second flapper 97 is pushed by the recording sheet 12 and pivots from the first position to the second position. In this regard, the ribs 97A of the second flapper 97 in the second position guide the recording sheet 12 in the main conveying direction 15 along the curved path 33 to the downstream side with respect to the merging point 102. As a tail end of the recording sheet 12 passes through the second flapper 97, the second flapper 97 pivots from the second position to the first position by itself due to the effect of gravity.

When the leading end of the recording sheet 12 guided along the curved path 33 reaches the conveyer roller pair 59, rotation of the conveyer motor 109 is switched from the reverse direction to the normal direction. Thereby, the rotation of the feeder roller 25 is stopped, and the conveyer roller 60, the ejection roller 62, and the reversible roller 67 rotate in the normal direction. Thus, the recording sheet 12 is conveyed downstream with respect to the recording unit 24 by the conveyer roller pair 59 in the main conveying direction 15. Thereafter, while the recording sheet 12 is supported by the platen 42, an image is formed on a first side of the recording sheet 12.

The recording sheet 12, with the image formed on the first side thereof, is conveyed by the ejection roller pair 44 along the linear path 34 in the main conveying direction 12 and contacts an upper surface 51 of the first flapper 49 to push the first flapper 49. Thereby, the first flapper 49 pivots against the urging force of the coil spring 86 to be in the second condition.

The first flapper 49 in the second condition is pushed by the recording sheet 12 to be separated from the first upper guide member 35. The first flapper 49 stays at the position separated from the first upper guide member 35 until the tail end of the recording sheet 12 passes through the first flapper 49. Thereafter, as the tail end of the recording sheet 12 conveyed by the reversible roller 67 rotating in the normal direction passes through the first flapper 49, the first flapper 49 is moved to pivot to the first condition by the urging force of the coil spring 86.

If the reversible roller 67 continues to rotate in the normal direction, the reversible roller pair 45 conveys the recording sheet 12 in the main conveying direction 15 to eject the recording sheet 12 in the ejection tray 21. Meanwhile, if the condition of the switching system 170 is switched to the second condition, and the conveyer motor 109 is driven to rotate in the reverse direction, the rotation of the reversible roller 67 is switched from the normal rotation to the reverse rotation, and the reversible roller pair 45 conveys the recording sheet 12 in the opposite direction from the main conveying direction 15. In this regard, the first flapper 49 is in the first condition to close the main conveyer path 65; therefore, the recording sheet 12 is guided along a lower surface 52 of the first flapper 49 to the inverting path 71. Thus, the first flapper 49 in the first condition guides the recording sheet 12, which is conveyed by the reversible roller pair 45 rotating in the reverse direction being the opposite direction from the main conveying direction 15.

As the directions to convey the recording sheet 12 switch, the former tail end (i.e., a rearward end) of the recording sheet 12 on the rear side now becomes a leading end, and the former leading end (i.e., a frontward end) of the recording sheet 12 on the front side now becomes a tail end in the inverting path 71. Thus, with the leading end on the rear side, when the recording sheet 12 is conveyed through the inverting path 71 and reenters the main conveyer path 65, the recording sheet 12 is inverted upside-down. Meanwhile, when the switching system 17 is placed in the second condition, and the conveyer motor 109 is driven in the reverse direction, the return-conveyer roller 22 rotates in the normal direction.

The recording sheet 12 is thus conveyed in the inverting direction 106 in the inverting path 71 by the return-conveyer roller pair 30 rotating in the normal direction to the second flapper 97 in the first position. The return-conveyer roller 22 conveys the recording sheet 12 reaching the second flapper 97 to exit the inverting path 71 and proceed beyond the merging point 102 to the curved path 33. In this regard, the curved surface 97B of the second flapper 97 in the first position guides the recording sheet 12 being conveyed by the return-conveyer roller 22 in the main conveying direction 15 to the main conveyer path 65.

When the recording sheet 12 conveyed in the curved path 33 reaches the conveyer roller pair 59, the conveyer roller 60 is in the reverse rotation; therefore, the recording sheet 12 may not be conveyed in the main conveying direction 15. In this regard, when the recording sheet 12 reaches the conveyer roller pair 59, the switching system 170 is switched from the second condition to the first condition. Further, the rotation of the conveyer motor 109 is switched to the normal direction so that the conveyer roller 60 should rotate in the normal direction. Accordingly, the recording sheet 12 is conveyed by the conveyer roller pair 59 in the main conveying direction 15 to reach the position below the recording unit 24. Meanwhile, when the switching system 170 is in the first condition and when the conveyer motor 109 is in the normal rotation, the return-conveyer roller 22 rotates in the normal direction. Therefore, even when the recording sheet 12 is nipped by both the conveyer roller pair 59 and the return-conveyer roller pair 30, the recording sheet 12 may be steadily conveyed by the conveyer roller 60 and the return-conveyer roller 22, which are in the normal rotation.

When the recording sheet 12 reaches the position below the recording unit 24, a second side of the recording sheet 12 faces with the recording unit 24 along the vertical direction 7 so that the recording unit 24 may record an image on the second side of the recording sheet 12. Thereafter, the recording sheet 12 with the images formed on the both sides thereof is conveyed by the ejection roller pair 44 and the reversible roller pair 45, which are in the normal rotation, to be ejected in the ejection tray 21. Thus, the recording sheet 12 may be inverted in the inverting path 71 and the main conveyer path 65 so that the recording sheet 12 may be conveyed in the inverting direction 106 to be directed to the main conveyer path 65 once again.

[Effects]

According to the embodiment described above, the drive shaft 28 to drive the return-conveyer roller 22 is supported directly by the base member 90; therefore, the return-conveyer roller 22 to convey the recording sheet 12 may be maintained by the base member 90 at a correct position in the inverting path 71, of which form is defined by the base member 90. Thereby, frequency of troubles on the recording sheet 12 being conveyed in the inverting path 71, such as skew or jam of the recording sheet 12, may be reduced, and the recording sheet 12 may be steadily and smoothly conveyed in the inverting path 71.

According to the embodiment described above, the feeder roller 25 and the second flapper 97 are supported by the base member 90; therefore, the feeder roller 25 and the second flapper 97 may be maintained at the correct positions on the base member 90. Thereby, the recording sheet 12, which is conveyed from the feeder tray 20 or the inverting path 71 through the merging point 102, may be conveyed to the position to face with the recording unit 24 correctly and steadily.

According to the embodiment described above, the second flapper 97 and the outer guide member 18, which may contact each other when the second flapper 97 is in the first position, are both supported by the base member 90; therefore, the positional relation between the second flapper 97 and the outer guide member 18 may be maintained steadily on the base member 90.

According to the embodiment described above, force in the direction to be urged against the recording sheet 12 may be applied to the feeder roller 25 and the return-conveyer roller 22 being in the normal rotation. Meanwhile, reaction force from the feeder roller 25 and the return-conveyer roller 22 may be applied to the drive shaft 28. In this regard, the drive shaft 28 is directly supported by the base member 90. Therefore, the feeder roller 25 and the return-conveyer roller 22 may be restrained from being displaced by the reaction force applied to the drive shaft 28 from the correct positions but may be maintained at the correct positions steadily.

According to the embodiment described above, the conveyer roller 60, the ejection roller 62, and the return-conveyer roller 67 are supported by the lateral frames 53. Therefore, the recording sheet 12 may be steadily conveyed in the area around the recording unit 24. Accordingly, while an image recording quality may tend to be lowered by the base member 90 being made of resin, with the arrangement of the conveyer roller 60, the ejection roller 62, and the return-conveyer roller 67 supported by the lateral frames 53, the image recording quality may be restrained from being lowered.

According to the embodiment described above, when the recording sheet 12 conveyed through the inverting path 71 reaches the conveyer roller 60, the recording sheet 12 may be subject to a force from the conveyer roller 60 and the reversible roller 67 in a reverse direction, and the recording sheet 12 may not be conveyed steadily. However, with the return-conveyer roller 22 attached to the return-conveyer arm 100 providing a greater amount of conveying force, and the drive shaft 28 of the return-conveyer roller 28 being directly supported by the base member 90, the recording sheet 12 may be conveyed steadily.

According to the embodiment described above, the conveyer roller 60, the ejection roller 62, the reversible roller 67, and the guide rails 56, 57 are supported by the lateral frames 53 while the guide rails 56, 57 supports the recording unit 24. Therefore, the positional relation among the conveyer roller 60, the ejection roller 62, the reversible roller 67, and the recording unit 24 may be maintained accurately. Accordingly, the image recording quality, which may tend to be lowered due to the base member 90 being made of resin, may be restrained from being lowered.

Modified Examples

Although an example of carrying out the invention has been described, those skilled in the art will appreciate that there are numerous variations and permutations of the image recording apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the feeder roller 25 and the return-conveyer roller 22 may not necessarily be rotated by the rotation of the same drive shaft 28 but may be rotated by rotation of different drive shafts.

For another example, the recording sheet 12 in the inverting path 71 may not necessarily be guided on the plurality of ribs 96, which are formed on the upper side of the rearward section 94 of the base member 90. For example, no rib 96 may be formed on the upper side of the rearward section 94 of the base member 90, but the recording sheet 12 may be guided by an upper plain surface of the rearward section 94 in the inverting path 71. In other words, the upper surface of the rearward section 94 may guide the recording sheet 12.

For another example, the recording sheet 12 from the feeder tray 20 may not necessarily be guided in the curved path 33 by the plurality of ribs 97A, which are formed on the outward face on the outer side of the curve of the second flapper 97. For example, no rib 97A may be formed on the outward face on the outer side of the curve of the second flapper 97, but the recording sheet 12 may be guided by a plain outward face of the curve of the second flapper 97. In other words, the outward face of the curve of the second flapper 97 may guide the recording sheet 12 along the curved path 33.

For another example, the quantity of the curved surfaces 97B formed on the inward face on the inner side of the curve of the second flapper 97 may not necessarily be three (3) but may be more or less. For another example, a plurality of ribs, which may be similar to the ribs 97A formed on the outward face on the outer side of the curve of the second flapper 97, may be formed on the inward face on the inner side of the curve of the second flapper 97.

For another example, the second flapper 97 may not necessarily be maintained at the first position by itself due to the effect of gravity when no force from any parts or components in the printer 11 is applied to the second flapper 97 but may be maintained at the first position by a force applied to the second flapper 97. For example, the second flapper 97 may be urged to the first position by an urging force from an urging member such as a coil spring.

For another example, the inverting path 71 may not necessarily be in the configuration described above or illustrated in FIG. 2 as long as the sides of the recording sheet 12 to face with the recording unit 24 are reversible.

For example, the branch point 101 may not necessarily be on the downstream side of the recording unit 24 with regard to the main conveying direction 15, or the merging point 102 may not necessarily be on the upstream side of the recording unit 24 with regard to the main conveying direction 15.

For another example, the inverting path may be in a configuration as depicted in FIG. 11. In FIG. 11, the branch point 101 and the merging point 102 may both be on the upstream side of the recording unit 24 in the main conveyer path 65 with regard to the main conveying direction 15. Meanwhile, the merging point 102 may be arranged on the upstream side of the branch point 101 in the main conveyer path 65 with regard to the main conveying direction 15. Further, the first flapper 49 may be supported pivotably by the guide member 43 at the branch point 101. A first roller pair 81 may be arranged in a position between the first flapper 49 and the recording unit 24 in the main conveyer path 65, and a second roller pair 82 may be arranged on the upstream side of the first flapper 49 with regard to the main conveyer path 65 with regard to the main conveying direction 15. Furthermore, a third roller pair 83 may be arranged in the inverting path 71. The second roller pair 82 may include an intermediate roller 84 and a first driven roller 85. The third roller pair 82 may include the intermediate roller 84, which is common with the second roller pair 82, and a second driven roller 87.

According to the example in FIG. 11, the form of the curved path 33 may be at least partly defined by the outer guide member 18 and the inner guide member 19. The form of the inverting path 71 may be defined by the upper guide member 110 and the rearward section 94 of the base member 90.

For another example, the second flapper 97 may not necessarily be arranged at the merging point 102 but may be omitted.

For another example, the inverting path 71 may not necessarily merge with the main conveyer path 64 at the curved path 33 but may merge with the main conveyer path 65 at the linear path 34. For example, the inverting path 71 may have a curved path, which is formed separately from the curved path 33, on the inner side of the curve of the curved path 33 so that the separately-formed curved path may merge with the linear path 34, and the recording sheet 12 may reenter the main conveyer path 64 through the separately-formed curved path.

What is claimed is:

1. An image recording apparatus, comprising:

a tray configured to support a sheet;

a chassis defining a first conveyer path, in which the sheet supported on the tray is conveyed in a first conveying direction, and a second conveyer path, which is branched from the first conveyer path at a branch point and merged with the first conveyer path at a merging point, the second conveyer path through which the sheet is conveyed in a second conveying direction guiding the sheet to be inverted to reenter the first conveyer path through the merging point;

a base member integrally formed of resin and comprising a guiding section, the guiding section defining a form of a part of the second conveyer path;

a recording unit configured to record an image on the sheet conveyed in the first conveyer path;

a drive shaft supported by the base member; and a return-conveyer roller disposed in the second conveyer path and configured to convey the sheet to be guided on the guiding section in the second conveying direction by rotation of the drive shaft.

2. The image recording apparatus according to claim 1, further comprising:

a feeder roller supported by the base member and configured to feed the sheet supported on the tray to the first conveyer path; and a flapper supported by the base member and configured to be movable to pivot between a first position, in which the flapper guides the sheet conveyed in the second conveyer path to the merging point by the return-conveyer roller to the first conveyer path, and a second position, in which the flapper guides the sheet fed to the first conveyer path by the feeder roller to a downstream of the merging point with regard to the first conveying direction.

3. The image recording apparatus according to claim 2, further comprising:

a guide member supported by the base member and defining a part of the first conveyer path, wherein the flapper is configured to contact the guide member when the flapper is in the first position, and wherein the flapper is configured to pivot from the first position to the second position by a contact with the sheet being conveyed by the feeder roller.

4. The image recording apparatus according to claim 2, wherein the feeder roller is configured to feed the sheet supported on the tray to the first conveyer path by rotation of the drive shaft.

5. The image recording apparatus according to claim 2, further comprising:

a return-conveyer arm pivotably supported by the drive shaft at one end thereof on an upstream with regard to the second conveying direction, the return-conveyer arm supporting the return-conveyer roller rotatably at the other end thereof on a downstream with regard to the second conveying direction; and a feeder arm pivotably supported by the drive shaft at one end thereof on an upstream with regard to a direction to feed the sheet, the feeder arm supporting the feeder roller rotatably at the other end thereof on a downstream with regard to the direction to feed the sheet.

6. The image recording apparatus according to claim 1, further comprising:

a pair of lateral frames made of metal, the pair of lateral frames each being supported by the base member on each side of the first conveyer path with regard to a widthwise direction which intersects with the first conveying direction, the pair of lateral frames each being arranged to spread along the first conveying direction;

a first conveyer roller supported by the pair of lateral frames at a position between the merging point and the recording unit in the first conveying direction, the first conveyer roller being configured to convey the sheet in the first conveyer path in the first conveying direction; and a second conveyer roller supported by the pair of lateral frames at a downstream of the recording unit with regard to the first conveying direction, the second conveyer roller being configured to convey the sheet in the first conveyer path in the first conveying direction.

7. The image recording apparatus according to claim 6, wherein the second conveyer roller is supported by the pair of lateral frames at a position on a downstream of the branch point with regard to the first conveying direction, the second conveyer roller being rotatable in a normal direction, in which the sheet in the first conveyer path is conveyed in the first conveying direction, and in a reverse direction, in which the sheet is conveyed in the second conveyer path through the branch point.

8. The image recording apparatus according to claim 7, further comprising:

a motor rotatable in a normal direction and a reverse direction; and a transmission configured to transmit driving force from the motor to the first conveyer roller, the second conveyer roller, and the return-conveyer roller, wherein the first conveyer roller, the second conveyer roller, and the return-conveyer roller are rotated in one direction by the driving force from the motor rotating in the normal direction transmitted through the transmission, and wherein the first conveyer roller and the second conveyer roller are rotated in a different direction, and the return-conveyer roller is rotated in the one direction, by the driving force from the motor rotating in the reverse direction transmitted through the transmission.

9. The image recording apparatus according to claim 6, further comprising:

a guide rail made of metal, the guide rail being supported by the pair of lateral frames and arranged to extend in the widthwise direction, wherein the recording unit comprises a carriage, the carriage being supported by the guide rail and configured to move in the widthwise direction, and a recording head mounted on the carriage and configured to discharge ink at the sheet.

* * * * *